US006405666B1

(12) United States Patent
Sahl

(10) Patent No.: US 6,405,666 B1
(45) Date of Patent: Jun. 18, 2002

(54) CHAIN STITCH SEWING MACHINE

(76) Inventor: Johannes Sahl, Tannenweg 17, Neuhofen/Krems A-4501 (AT)

( * ) Notice: Subject to any disclaimer, the term of this patent is extended or adjusted under 35 U.S.C. 154(b) by 0 days.

(21) Appl. No.: 09/914,738

(22) PCT Filed: Jan. 21, 2000

(86) PCT No.: PCT/AT00/00015

§ 371 (c)(1),
(2), (4) Date: Sep. 4, 2001

(87) PCT Pub. No.: WO00/43583

PCT Pub. Date: Jul. 27, 2000

(30) Foreign Application Priority Data

Jan. 21, 1999 (AT) ..... 76/99

(51) Int. Cl.[7] ..... D05B 49/04
(52) U.S. Cl. ..... 112/248
(58) Field of Search ..... 112/241, 242, 112/243, 248, 246, 249, 163, 165, 254, 245

(56) References Cited

U.S. PATENT DOCUMENTS

| | | | | |
|---|---|---|---|---|
| 2,385,960 A | | 10/1945 | Zonis | |
| 2,398,667 A | | 4/1946 | Rubel et al. | |
| 2,895,441 A | * | 7/1959 | Engel et al. | 112/248 |
| 5,085,159 A | | 2/1992 | Kasuda et al. | |
| 5,732,640 A | * | 3/1998 | Mizusaki et al. | 112/248 |
| 5,806,448 A | | 9/1998 | Matsuo et al. | |
| 6,263,812 B1 | * | 7/2001 | Chen | 112/248 |

FOREIGN PATENT DOCUMENTS

| | | | | |
|---|---|---|---|---|
| JP | 1199895 | * | 9/1986 | 112/302 |

* cited by examiner

*Primary Examiner*—Ismael Izaguirre
(74) *Attorney, Agent, or Firm*—Collard & Roe, P.C.

(57) ABSTRACT

The invention relates to a chain stitch sewing machine (1) having a needle bar (5) mounted in a housing (4) in such a way that it can be lifted and driven and at least one sewing needle (7, 8) that can be fixed on the needle head (6) of the needle bar (5), to which a sewing thread (12, 13) can be fed from a thread spool (14) by means of a tightener (15) and a thread guiding device (16), wherein the thread guiding device (16) comprises a thread takeup (17) controlling thread tension depending on the lift of the needle bar. In order to easily adapt the tension of the thread to the stitch operations during sewing, the thread takeup (17) consists of a feed disk (20) resting on a feed shaft (22) that can be driven synchronously relative to the drive mechanism of the needle bar (9), said disk forming an eccentric takeup cam (23) for receiving the thread on the side of the periphery and projecting ,with said takeup cam (23) in-between two thread eyelets (24, 25) fixed to the housing for the sewing thread (12, 13) that runs crosswise in relation to the feed disk (20) through the takeup cam (23) and/or a thread control device (18, 19) is mounted downstream of the thread takeup (17) for each sewing thread (12, 13), said thread control devices having a control disk (28, 29) resting on a control shaft (27) with a control cam (30, 31) mounted on the side of the periphery for the sewing threads (12, 13) which are guided through the thread eyelets (32, 33) that are fixed on the housing on both sides of the control disk (28, 29).

2 Claims, 3 Drawing Sheets

CHAIN STITCH SEWING MACHINE

CROSS REFERENCE TO RELATED APPLICATIONS

Figure 1:
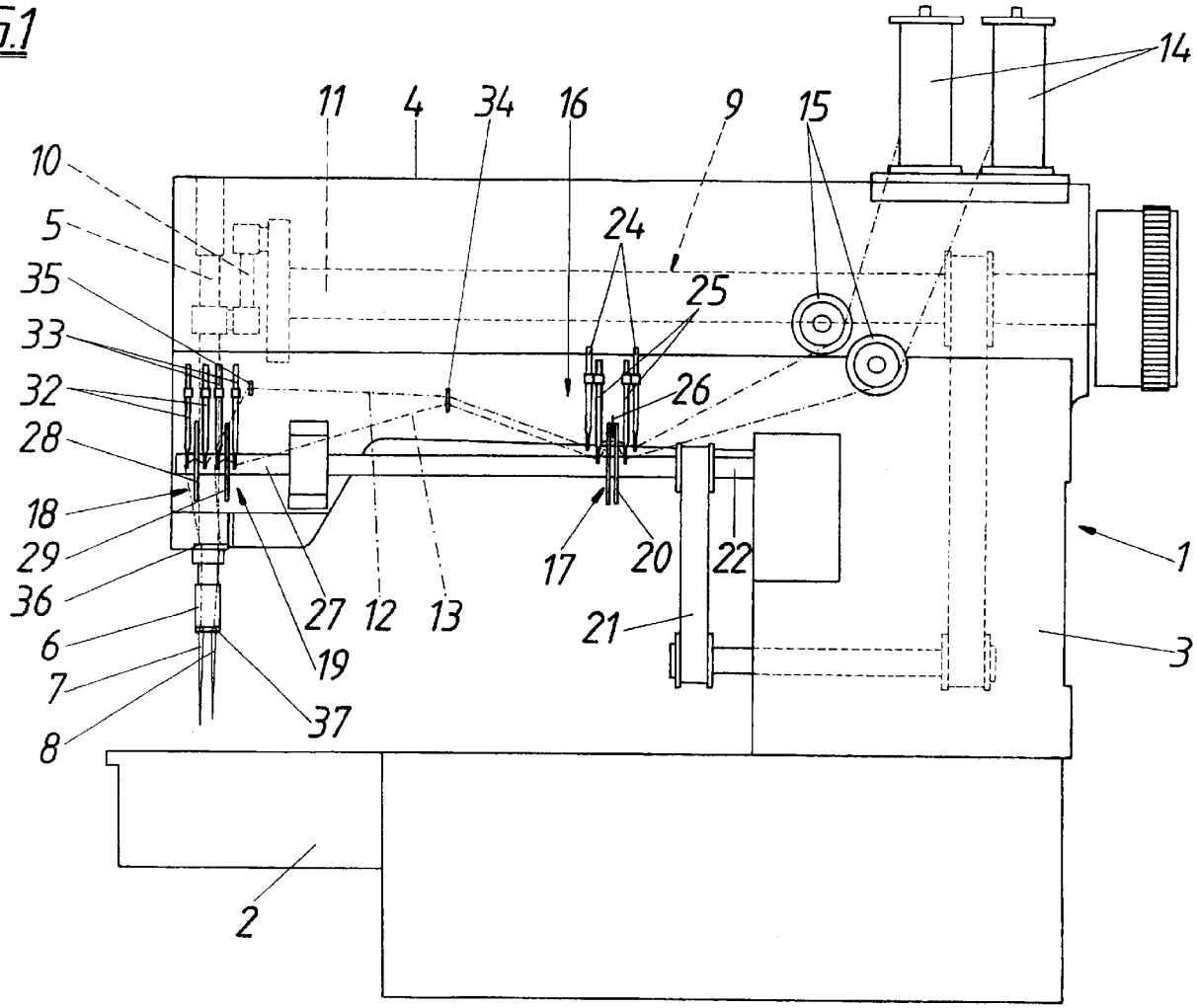

Applicant claims priority under 35 U.S.C. §119 of Austrian Application No. A 76/99 filed Jan. 21, 1999. Applicant also claims priority under 35 U.S.C. §120 of PCT/AT00/00015 filed Jan. 21, 2000. The international application under PCT article 21(2) was not published in English.

The present invention relates to a chain stitch sewing machine having a needle bar mounted in a housing in such a way that it can be lifted and driven and at least one sewing needle which can be fixed on the needle head of the needle bar, to which a sewing thread can be fed by a thread spool by means of a tightener and a thread guiding device, whereby the thread guiding device comprises a thread takeup controlling the tension of the thread depending on the lift of the needle bar.

These sewing machines sew according to the chain stitch principle, whereby the sewing thread loops formed respectively during a needle insertion is guided through by the thread loop of the same or another sewing thread of the preceding stitch and is held by the following thread loop. The chain stitch can be formed with one or more sewing threads and the chain stitches are suited to tensed stitches and the sewing of elastic textiles due to their ductility. In the process the thread takeup plays an important role, since it must provide the quantity of sewing thread required for the stitching procedure, take them back again after the looping of surplus threads and tighten the thread looping thus formed. Known thread takeups have a thread eyelet integral with the housing and a thread eyelet which can be moved up and down with the lift of the needle bar, giving rise to a thread tension dependent on the lift of the needle on account of the relative movement of both eyelets.

Stoppage of the thread takeup and a thread-guiding procedure insufficient for the critical stitch formation phases occur however during the lifts of the needle bar as the lower and upper dead centers are reached, by means of which for example the thread looping is tightened only partially by means of the thread takeup, but also partially by the advance of the material to be sewn and the material is drawn together because of the thread tension to be increased, resulting in unwanted crimped and gathered sewn areas in the case of elastic textiles.

The object of the present invention is therefore to provide a chain stitch sewing machine of the type initially described, which allows the sewing of flawless, even chain stitches by means of an improved thread guiding device also with highly elastic sewing materials.

The invention solves this task by the fact that the thread takeup has a feed disk resting on a feed shaft which can be driven synchronously to the needle bar, which forms on the periphery side an eccentric takeup cam for takeup of threads and with this takeup cam projects between two thread eyelets supported fast to the housing for the sewing thread running transversely to the feed disk by way of the takeup cam, and/or a thread control device is mounted in the direction of thread tightening downstream of the thread takeup for each sewing thread, which thread control device respectively has a control disk resting on a control shaft which can be driven synchronously to the needle bar with a control cam on the periphery side for the sewing threads guided by two thread eyelets supported fast to the housing on both sides of the control disk by way of the control disk.

By use of a rotating feed disk as thread takeup the sewing thread can be controlled according to the run of the takeup cam rotating with the feed disk relative to the stationary thread eyelets and be provided and taken back in a thread quantity adapted to the respective stitching procedure, without having to observe stoppage determined by the dead center, such that in particular thread tension and tightening of the thread looping are enabled essentially by the thread takeup alone. The reactions of the thread tensions on the sewing material are accordingly minimal and crimping of seams and the like are extensively avoided. The feed shaft drive can be easily diverted by the rotary drive of the needle bar and the feed disk can be designed as single or double disk and also be fitted with a thread stripper or the like for guiding threads in the vicinity of the takeup cam.

If a thread control device according to the present invention is provided in addition to the thread takeup, the tension of each sewing thread can be stabilised individually and controlled and adapted to the stitching procedure belonging thereto especially. This thread control device can be combined with a conventional thread takeup, though there is understandably a better control and coordination option for the thread tension with a combination with the new thread takeup, which can then have a feed disk common to all sewing threads. The thread takeup and its influence on the thread tension are thus overridden by the thread run conditions on the basis of the control disks, by means of which the thread tension required for each sewing thread can be adjusted exactly to the thread tension required for the respective stitching procedure. The advance or retraction of the thread resulting during the to-and-fro stitching motion of the sewing needle depending on the path of the takeup cam on the one hand and the respective control cam on the other hand produces precise stitching, without noticeable reaction to the sewn material, whereby the widest range of chain stitches can be created perfectly and with optimum quality with one or more sewing needles and one or more sewing threads assigned thereto.

The control shaft is effectively designed as an extension of the feed shaft, so that a common drive results for the thread takeup and the thread control device, If several sewing threads and thus also several thread control devices are provided, the control disks of all thread control devices can sit on one and the same control and feed shaft.

Figure 2:
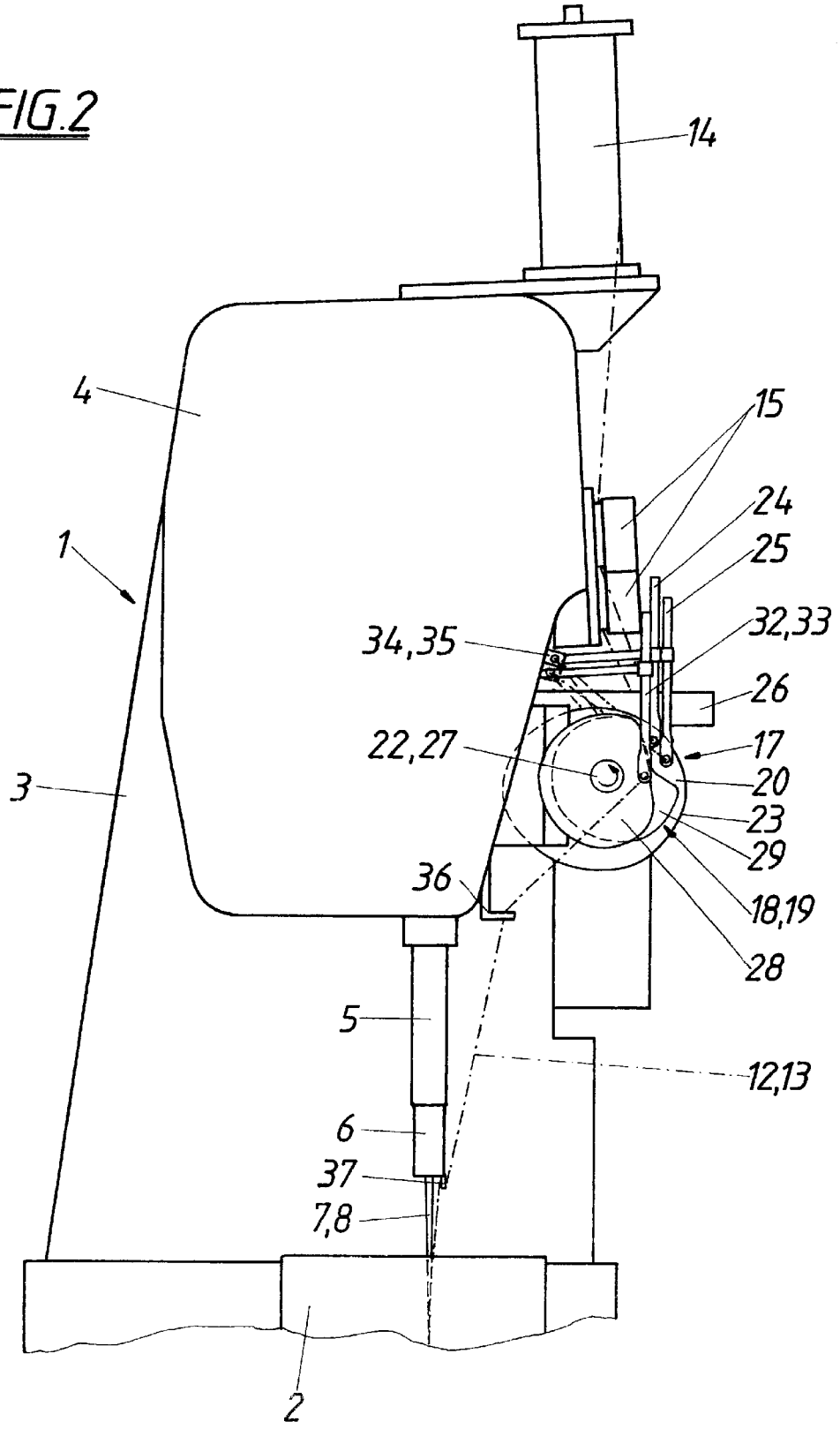
Figure 3:
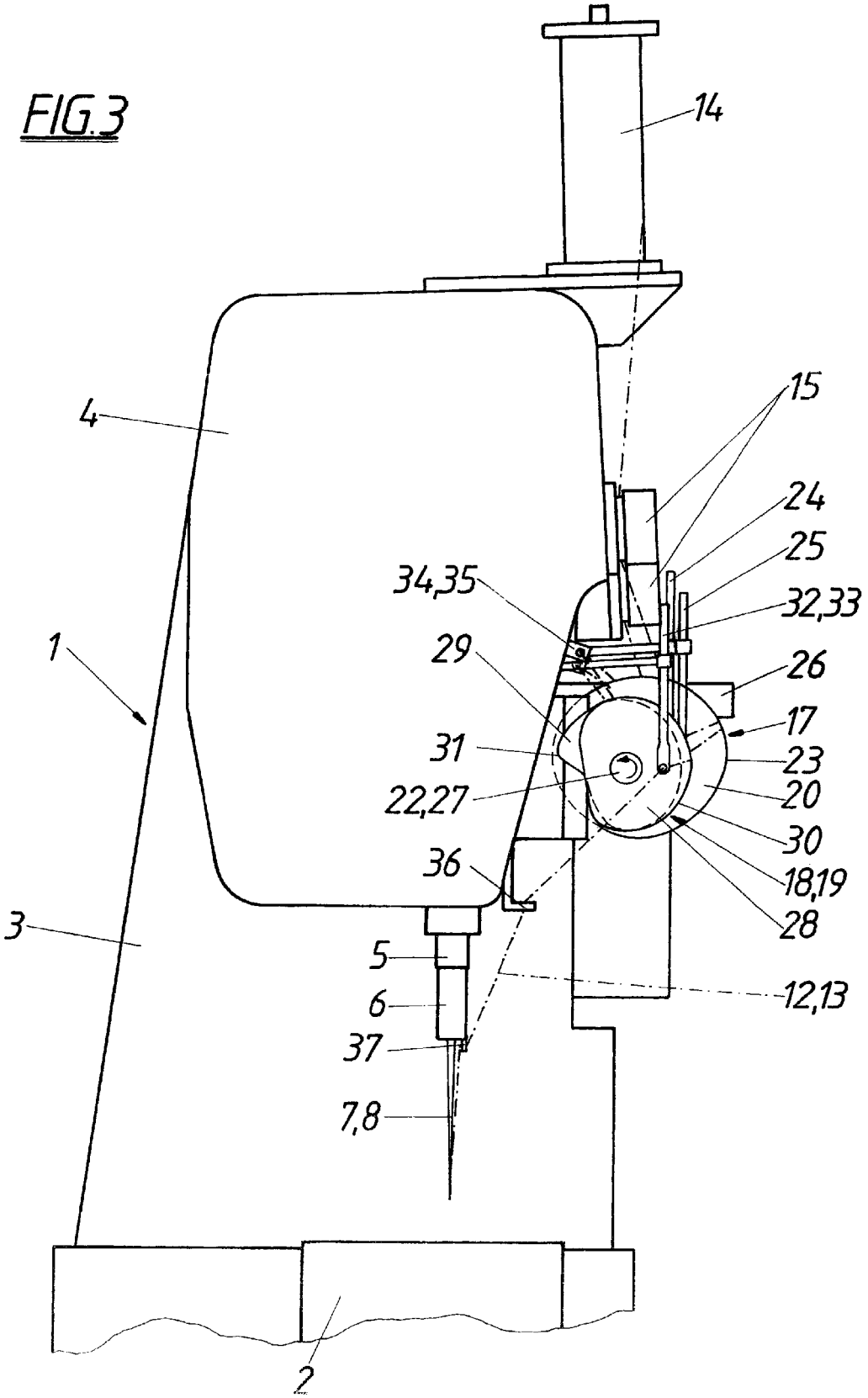

The diagram illustrates the inventive object purely diagrammatically, wherein FIG. 1 illustrates chain stitch sewing machine according to the present invention in side elevation and FIGS. 2 and 3 illustrate this sewing machine with its needle bar in the lower dead center or in the upper dead center in side elevation on an enlarged scale.

A two-needle chain stitch sewing machine 1 with a substructure 2 to accommodate a takeup, not illustrated in detail here, and the assigned thread takeup guide device exhibits a superstructure 3 with a needle bar 5 mounted in a housing 4 such that it can move up and down, on needle head 6 of which are fixed two sewing needles 7,8. An upper drive shaft 11 engaging by way of a crank mechanism 10 on needle bar 5 serves as needle bar 9. Assigned to both sewing needles 7,8 are two sewing threads 12,13 which are guided by thread spools 14 by way of tighteners 15 and a thread guiding device 16 to sewing needles 7,8. The thread guide device here comprises a thread takeup 17 controlling the thread tension depending on the lift of the needle bar and also comprises a thread control device 18,19 for individua control of the thread tension for each sewing thread 12,13.

The thread takeup 17 comprises a feed disk 20 which sits on a feed shaft 22 which can be driven synchronously by way of a drive connection 21 with needle bar 9, and with a takeup cam 23 on the periphery side projects between each of two thread eyelets 24,25 supported fast to the housing for both sewing threads 12,13 running transversely to feed disk 20 by way of takeup cam 23. Feed disk 20 comprises two part disks, between which a thread stripper 26 engages to control the path of the threads.

Thread control devices 18,19 each exhibit a control disk 28,29 resting on a control shaft 27 designed as an extension of feed shaft 22 and also driven synchronously with needle bar 9, which control disks exhibit control cams 30,31 on the periphery side and with these project between two thread eyelets 32,33 supported fast to the housing for sewing threads 12,13 guided transversely by way of control disks 28,29.

The sewing threads 12,13 thus run in thread guiding device 16 from thread takeup 17 by way of corresponding deflection guides 34,35 to thread control devices 18,19 and from there by way of another thread guide 36 integral with the housing or a thread guide 37 fixed to the needle head to the needle eyelets. Appropriate arrangement of takeup cam 23 on the one hand and control cams 30,31 on the other hand therefore enables sewing threads 12,13 to adapt individually in tension to the assigned stitching procedure, and enables the sewing threads to be released corresponding to the respective thread looping phase in a precisely coordinated quantity and thus provide or withdraw and tighten the formed loops. This loop forming and tightening proceeds without noticeable reaction on the sewn material, resulting in perfect chain stitching without the sewn material being gathered or crimped.

What is claimed is:

1. Chain stitch sewing machine having a needle bar mounted in a housing in such a way that it can be lifted and driven and at least one sewing needle which can be fixed on the needle head of the needle bar, to which a sewing thread can be fed by a thread spool by means of a tightener and a thread guiding device, whereby the thread guiding device comprises a thread takeup controlling the tension of the thread depending on the lift of the needle bar, characterised in that the thread takeup (17) consists of a feed disk (20) resting on a feed shaft (22) which can be driven synchronously relative to the drive mechanism of the needle bar (9), said disk forming an eccentric takeup cam (23) for receiving the thread on the side of the periphery and projecting with said takeup cam (23) in between two thread eyelets (24, 25) fixed to the housing for the sewing thread (12, 13) which runs crosswise in relation to the feed disk (20) through the takeup cam (23) and/or a thread control device (18, 19) is mounted downstream of the thread takeup (17) for each sewing thread (12, 13), said thread control devices having a control disk (28, 29) resting on a control shaft (27) with a control cam (30, 31) mounted on the side of the periphery for the sewing threads (12, 13) which are guided through the thread eyelets (32, 33) fixed on the housing on both sides of the control disk (28, 29).

2. Chain stitch sewing machine as claimed in claim 1, characterised in that the control shaft (27) is designed as an extension of the feed shaft (22).

* * * * *